United States Patent [19]

Jenkins

[11] Patent Number: 4,488,415

[45] Date of Patent: Dec. 18, 1984

[54] RING WITH REPLACEABLE STONES

[76] Inventor: Mary A. Jenkins, 364 Timberlane Dr., Gretna, La. 70053

[21] Appl. No.: 541,043

[22] Filed: Oct. 12, 1983

Related U.S. Application Data

[63] Continuation-in-part of Ser. No. 477,153, Mar. 21, 1983.

[51] Int. Cl.[3] ..... A44C 17/02

[52] U.S. Cl. ..... 63/29 R

[58] Field of Search ..... 63/2, 1, 29 R, 28

[56] References Cited

U.S. PATENT DOCUMENTS

| | | | |
|---|---|---|---|
| 948,044 | 2/1910 | Fishel | 63/28 |
| 1,578,940 | 3/1926 | Wacha | 63/2 UX |
| 1,712,171 | 5/1929 | Rochas | 63/29 R |
| 3,412,578 | 11/1968 | Rosencrans | 63/29 R X |
| 3,568,467 | 3/1971 | Ellison | 63/29 R |

FOREIGN PATENT DOCUMENTS

| | | | |
|---|---|---|---|
| 781628 | 2/1935 | France | 63/29 R |
| 1319354 | 1/1963 | France | 63/29 R |
| 341345 | 11/1959 | Switzerland | 63/29 R |

*Primary Examiner*—F. Barry Shay

*Attorney, Agent, or Firm*—Wilkinson, Mawhinney & Theibault

[57] ABSTRACT

A ring or article of decorative jewelry is provided that has multiple interchangeable decorative stones. The ring is made with a flexible hinged top piece securing large polished stones against a bezel upstanding from the ring. The stones securely gripped by the flexible spring action of the hinged lid and it is unnecessary that the stones themselves be placed in any form of intermediate mounting.

1 Claim, 1 Drawing Figures

FIG 6
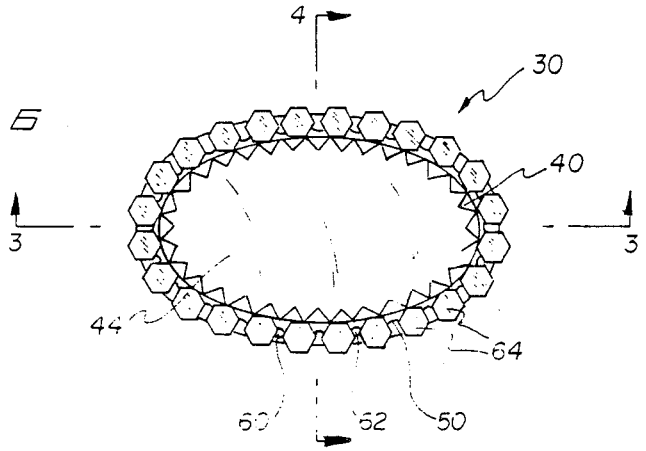
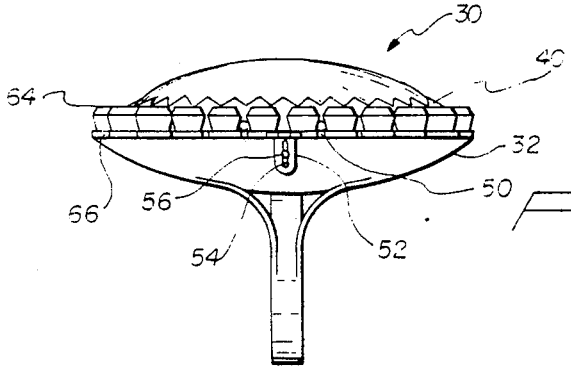
FIG 7
FIG 8
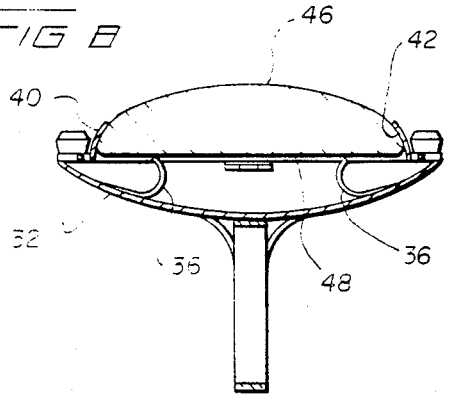
FIG 9
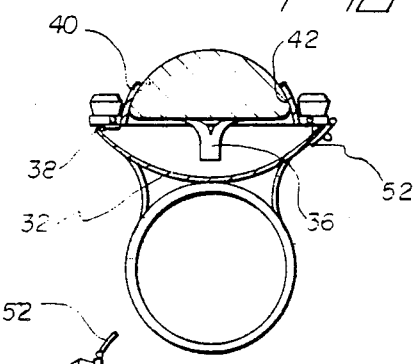
FIG 11
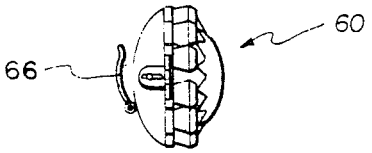
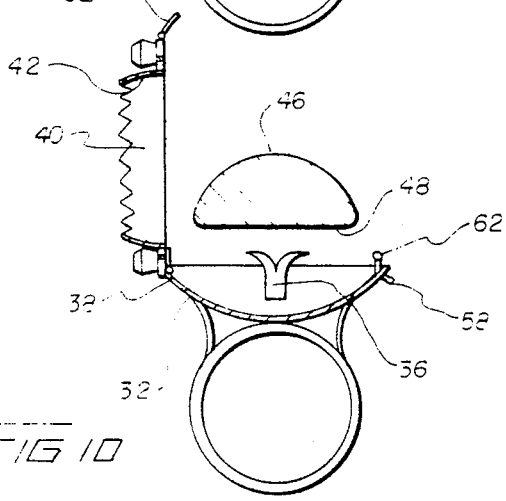
FIG 10

RING WITH REPLACEABLE STONES

This is a continuation-in-part of application Ser. No. 477,153, filed Mar. 21, 1983, entitled: Ring with Replaceable Stones.

BACKGROUND OF THE INVENTION

This invention relates to articles of personal adornment, especially to rings for wearing on the fingers or similar jewelry having an ornamental or decorative, precious or semi-precious stone inserts.

Previous attempts have been made to provide various articles of jewelry where the decorative portion of the jewelry can be interchanged. Typical of such attempts are U.S. Pat. No. 3,933,011, DiGilio et al, disclosing a ring having a removable and interchangeable jewelry mount. In the case of DiGillio, the ornamental portion of the ring is mounted in a rather complex structure having a keyed-interlocking mechanism which mates with slots on the jewelry to be worn. Variance of this construction may be seen, for example, in U.S. Pat. No. 3,307,375, Estrin, where a ring is provided with an interchangeable decorative stone. This patent shows a different interlocking mechanism but still discloses the general requirement that the decorative or ornamentive piece of the ring must itself be permanently affixed to a mount which can then be interlocked or interlinked to the ring.

U.S. Pat. No. 4,218,894, Tropea, and U.S. Pat. No. 2,674,107, Bodnar, both show various forms of elaborated mountings which are interchanged to the article of jewelry. The decorative portion of the jewelry is itself firmly affixed to the mounting.

Where it is desired to interchange simply the decorative stone, as would be desirable in the case of precious or semi-precious stone which may be damaged by being permanently affixed or glued to an intermediate mount, the prior art has, in order to securely affix the stone, consisted of various methods of mounting and clamping the stone insertably from the bottom of the ring, or the inside of the ring, against a strong, securely retaining net, such as shown, for instance, in U.S. Pat. No. 1,182,534, Drigott, showing a gem-clamping device to allow such a mounting. More recent versions of such interchangeable mountings are shown in U.S. Pat. No. 2,733,579, Pfeffer, and U.S. Pat. No. 3,913,184, Hannan. In all these cases the adequate securing of the unmounted stone requires a relatively complex mechanical locking in order to secure the stones. The stones themselves are restricted by the makeup of the ring or the jewelry to being a relatively small size and the stones are not interchangeable by the user without access to jewelers tools and some degree of mechanical skill.

It is the object of this invention to overcome the current usage restrictions of these prior art mountings by providing a ring having a simplified mounting method such that the user may himself/herself replace the decorative component of the ring or the precious stone therein as desired from a selection of decorative or precious stones.

It is a further object of the invention to provide a ring interchangeable mounting method permitting the use of much larger decorative stones than has heretofore been possible.

It is further an object of this invention to provide a ring which will mount interchangeable decorative or precious stones without requiring that an intermediate, permanent mounting be affixed to said decorative or precious stones.

In accordance with the invention, a ring is provided having an expanded, cup-shaped bezel of a light but strong wire-like configuration and of a size conformable to the desired size of the interchangeable stones to be provided. There is also provided adaptably conformed to the ring a series of various precious or semi-precious stones which can be of any generally symmetrical or pleasing shape, having only the condition that the outer edge shall be sized and shaped conformably with the upper outer edge of the bezel. Affixed to the bezel by a hinged means is a generally spring-like cover ring which, being pivoted on its hinge, may be lowered over any of the selection of provided stones firmly by spring-like action grasping and clamping the stone at its edges or periphery to the bezel. This spring-like edge or clasping ring is further provided opposite to the hinge with a catch or securing hook which secures and use both by inate grasping of the design of the catch or hook itself as well as being further securely locked into position by the spring-like action of the top ring for securing the lid.

For a better understanding of the invention, as well as the advantages and novel features thereof, reference is made to the following description which should be read in conjunction with the accompanying drawings which show by way of example the invention embodied in a ring for use upon the finger.

DESCRIPTION OF THE DRAWINGS

FIG. 6 is a top plan view of a modified form of the ring of FIGS. 1 through 5.

FIG. 7 is a side elevational view of the ring of FIG. 6.

FIG. 8 is a vertical sectional view taken along the major axis of FIG. 7.

FIG. 9 is a transverse sectional view taken along the minor axis of FIG. 6.

FIG. 10 is a sectional view similar to FIG. 9 with the cover open and the replaceable stone raised above the bezel base.

FIG. 11 is an end elevational view of an ear ring constructed in accordance with the present invention.

DETAILED DESCRIPTION OF THE INVENTION

Figure 1:
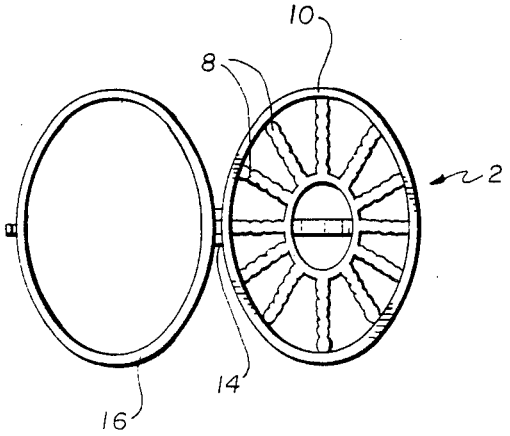
FIG. 1 is a top view of the device with no stone inserted.
Figure 4:
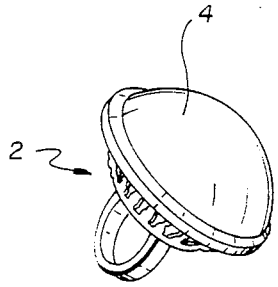
FIG. 4 is a perspective view of the device as it would be worn with a stone inserted.

Referring now more particularly to FIGS. 1 through 5 of the drawings, the reference numeral 2 refers generally to the device within which is placed any one of a number of removable, unmounted stones or similar decorative items 4.

Figure 2:
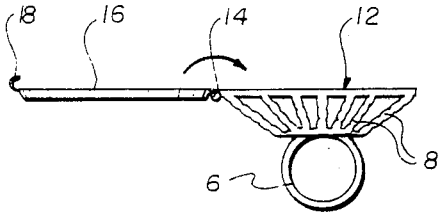
FIG. 2 is a front view of the device showing the hinge action of the spring lid.

Referring more specifically to FIG. 2, the device comprises essentially a ring 6 of design suitable for wearing upon a finger. Fixably attached to said ring 6 are a number of rising pillar members 8 which terminate in a bezel top ring 10 which is disposed essentially perpendicular to the ring 6.

The support members 8 and the bezel ring 10 together form the bezel 12.

Figure 3:
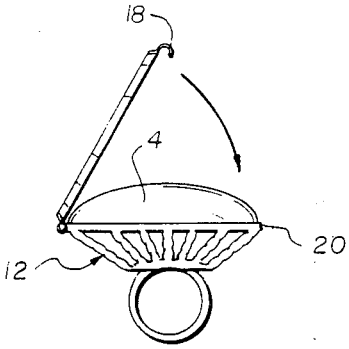
FIG. 3 is a front view of the device with a stone inserted showing the function.
Figure 5:
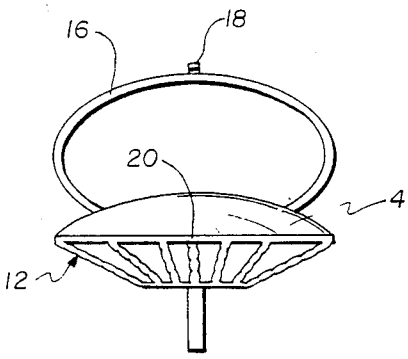
FIG. 5 is a side view of the device with a stone inserted showing another view of the lid.

Referring now particularly to FIGS. 1, 3 and 5, the bezel ring 10 is seen to be of a desirable decorative shape having a somewhat wider surface on its top than its thickness. A number of decorative stones, not shown, all of which are polished and shaped to the general shape of the decorative stone 4, may be provided. Such stone 4 is placed, as shown in FIG. 3, conformatively upon the bezel member in the preferred embodiment resting primarily upon the surface of the ring 10. Provided also upon the ring 10, connected through hinge 14, is a top ring 16 which is of a shape adaptably sized to the configuration, shape and size of bezel top ring 10. Said securing ring or top lid 16 is comprised of an essentially springy resilient material in the preferred embodiment a goldplated spring metallic component. Further provided on top lid 16 opposite to hinge 14 is catch 18 which mates upon closing with the lip, or outer edge, of top ring 10 at point 20. The hooking action of the clasp, together with the tension imposed by the spring action of top ring 16, securely closes the clasp securely holding stone 4.

In operation, the user finding the ring as shown in FIG. 2 with the lid open to its widest extent, as shown in FIG. 3, places therein a stone 4 selected as before stated from any of a number of similarly provided decorative stones cut to shape. Lid 16 is then pivoted about hinge 14 pressingly downward, as shown in FIG. 3, until catch 18 engages with bezel lid top 10 at point 20. The spring tension upon lid 16 together with the hook, or clasp-shaped clasp 18, will, as is apparent to anyone skilled in the art, securely clasp at point 20 holding stone 4 firmly within the ring 2.

As the user will wish to change stones, it is merely necessary to, with a fingernail or small implement such as fingernail file, pryingly separate clasp 18 from its hook location at point 20 around bezel top 10 permitting lid 16 to be raised, as shown in FIG. 5, and the stone thus being exposed to removal may be lifted out and replaced. The user then proceeds as before stated to insert yet another stone and repeat the process.

As can be seen from this description, it is not necessary that the stone itself have permanently affixed thereto a mount nor is there a mount upon the stone which is required for interlocking with the ring.

Specific tools or skills are not required to open or close the ring. There are no loose moving parts provided, yet the spring action of the top lid and bezel being applied at the outer periphery will uniformly seat about the stone 4 securely clasping the stone 4 against any tendency for it to be ejected or lost.

Further as may be seen from the description, the limit of the extent of the pillars 8 and thereby the size of the ring 10, the bezel and the resulting permitted size of the stone 4 comformably matching thereto is limited essentially by the artistic desires of the specific ring constructed, thereby particularly large stones are permitted to be used interchangeably for a more pleasing decorative effect.

From the above it can thus be seen that the invention comprises, in addition to the specific configuration discussed, such similar configurations and sizes as would readily appear to those skilled in the art.

Referring now to FIGS. 6 through 11, 30 represents a ring bezel 32 which may be circular or ellipsoidal and of dish like shape. Upstanding from each end of the major axis of the ellipse are spring members 36 of bifurcated construction. Hinged to one side of the ellipse, across its minor axis at 38 is a complemental elliptical cover or lid 40 having its central portion 42 cut away so that any one of a plurality of very decorative highly polished stones 44 having geometric similitude with the cover or clamping lid 40 may be observed. The stones 44 have arcuate tops 46 and flat bases 48. The bases of the stones rest upon the free ends of the bifurcated spring members 36 so that upon closing the lid or cover 40 over the stone 44 it is supported and urged upwardly in the lid so that its highly polished arcuate or domed portion 46 projects through the central cut away portion 42.

Outwardly of the elliptical cover or lid 40 are a plurality of quartz zircons 64 each mounted in an individual setting 66 tied together by a wire-like connection at 50.

A clasp plate 52 is hingedly connected between two adjacent settings 48 as best seen in FIG. 7. The plate 52 has a slot 54 and central opening 56 to permit passage through the opening 56 of the cover retaining projection 58 attached to the underside of the bezel 32.

Carried along the top edge of the dished shaped bezel 32 are two spaced apart projections 60, 62 which are resiliently biased to snap between two zircon settings to assist in retaining the lid 40 down tightly against the bezel 32 which also cooperates with hinged plate 52 to assure against fortuitous opening of the lid 40 with the resultant loss of the polished stone 44.

Any one of a plurality of polished stones having different granular structure or color may be placed in the bezel and the lid 40 locked in place.

While FIGS. 6 to 10 show the invention applied to the person of the wearer by a finger ring; however as shown in FIG. 11 the invention may be applied in slightly smaller geometric form as an ear ring 60 having a conventional ear attaching clasp 66 thereon.

What I claim is:

1. An improved article of personal adornment comprising:

(a) a base having means for attachment of the article to a person;

(b) a bezel upstanding from said base having an essentially flat, extended top arising vertically therefrom;

(c) a clamping lid hingedly affixed to said bezel to one side thereof and being geometrically similar to said bezel;

(d) fixed stone mounting means exteriorly mounted about said clamping lid for nonremovably mounting a contiguous array of stones about the clamping lid;

(e) a plurality of interchangeable stones of decorative appearance sizably adapted to and geometrically similar to the bezel; and (f) clasp means one component of which is a pivoted latch plate having a slotted opening through which a projection upstanding from said bezel passes and a secondary clasp means having at least one projection upstanding from said bezel base adapted to snap fit between adjacent fixed stones mounted about said clamping lid to securely affix the lid to the bezel base to retain the interchangeable stone in place.

* * * * *